US007607960B2

(12) United States Patent
Kobayashi

(10) Patent No.: US 7,607,960 B2
(45) Date of Patent: Oct. 27, 2009

(54) SOUNDING TOOL FOR CHEERING

(75) Inventor: Yuu Kobayashi, Kobe (JP)

(73) Assignee: Sharp Sangyo Co., Ltd., Kobe-shi (JP)

( * ) Notice: Subject to any disclaimer, the term of this patent is extended or adjusted under 35 U.S.C. 154(b) by 294 days.

(21) Appl. No.: 11/794,326

(22) PCT Filed: Jul. 21, 2006

(86) PCT No.: PCT/JP2006/314458

§ 371 (c)(1),
(2), (4) Date: Jun. 28, 2007

(87) PCT Pub. No.: WO2007/011015

PCT Pub. Date: Jan. 25, 2007

(65) Prior Publication Data

US 2008/0038987 A1 Feb. 14, 2008

(30) Foreign Application Priority Data

Jul. 22, 2005 (JP) ..... 2005-212401

(51) Int. Cl.
*A63H 5/00* (2006.01)

(52) U.S. Cl. ..... 446/421; 446/397; 446/297; 446/268

(58) Field of Classification Search ..... 446/418–422, 446/397, 297–303, 68, 812
See application file for complete search history.

(56) References Cited

U.S. PATENT DOCUMENTS 2,137,651 A * 11/1938 Larrabee ..... 446/421
3,019,553 A * 2/1962 Gomez et al. ..... 446/422

(Continued)

FOREIGN PATENT DOCUMENTS

| | | |
|---|---|---|
| JP | 3-20879 | 5/1991 |
| JP | 5-4200 | 1/1993 |
| JP | 5-45796 | 6/1993 |

(Continued)

*Primary Examiner*—Gene Kim
*Assistant Examiner*—Urszula M Cegielnik
(74) *Attorney, Agent, or Firm*—Kratz, Quintos & Hanson, LLP

(57) ABSTRACT

A highly interesting sounding tool for cheering is provided. The sounding tool 1A comprises a pair of right and left clapping bars 2R and 2L, and a hollow cover body 10 having a shape imitating an object for enhancing interest. Both clapping bars 2R and 2L are pivotally joined at a position between the beating portion 3 and the gripping portion 4 such that the beating portions 3 and gripping portion 4 can be opened/closed. Both clapping bars 2R and 2L vertically penetrate the cover body 10 between the front and rear wall portions 11 and 11. Guide groove portions 15R and 15L are provided, respectively, on the inner right and left side surfaces of the front and rear wall portions 11 and 11 of the cover body 10 so as to be vertically apart from each other. Guide protruded portions 5R and 5L are provided, respectively, on the front and rear surfaces of the right and left clapping bars 2R and 2L so as to be vertically apart from each other. The guide protruded portions 5R and 5L are fitted in the guide groove portions 15R and 15L. When the guide protruded portions 5R and 5L move along the guide groove portions 15R and 15L, the beating portions 3 and 3 of the right and left clapping bars are guided in the opening and closing directions.

5 Claims, 9 Drawing Sheets

U.S. PATENT DOCUMENTS

| | | | | |
|---|---|---|---|---|
| 3,271,898 | A * | 9/1966 | Glass et al. | 446/301 |
| 4,810,228 | A * | 3/1989 | Huggins | 446/418 |
| 4,976,651 | A * | 12/1990 | Frank | 446/421 |
| 5,094,317 | A | 3/1992 | Ladendorf | |
| D403,323 | S * | 12/1998 | Davies | D14/187 |
| 5,984,761 | A * | 11/1999 | Kalinowski | 446/421 |
| 6,506,092 | B1 * | 1/2003 | Kuracina et al. | 446/418 |
| 6,817,922 | B1 * | 11/2004 | Davies | 446/421 |
| 7,146,648 | B1 * | 12/2006 | Kessee | 446/26 |
| 2004/0077275 | A1 * | 4/2004 | Burbank | 446/321 |
| 2008/0282960 | A1 * | 11/2008 | Sherrod | 116/173 |

FOREIGN PATENT DOCUMENTS

| | | |
|---|---|---|
| JP | 7-210168 | 8/1995 |
| JP | 977617 | 3/1997 |
| JP | 10-91168 | 4/1998 |
| JP | 3062631 | 7/1999 |
| JP | 2996649 | 10/1999 |
| JP | 2001-75573 | 3/2001 |
| JP | 2001-117565 | 4/2001 |
| JP | 1229544 | 2/2005 |
| JP | 3110439 | 5/2005 |

* cited by examiner

SOUNDING TOOL FOR CHEERING

TECHNICAL FIELD

The present invention relates to a sounding tool for cheering typically used at the time of watching sport.

BACKGROUND ART

As a sounding tool for cheering used for cheering various sports, such as, e.g., baseball, volleyball, soccer, or basketball, a sounding tool having a pair of right and left clapping bars (the so-called clappers) pivotally connected with each other in an openable/closable manner is known. This sounding tool is configured to make a sound by repeatedly opening/closing the beating portions of the clapping bars to hit with each other at the time of cheering.

The clapping bars of this kind of sounding tool are generally constituted by two megaphone halves. At the time of cheering with voice, this sounding tool is used as a megaphone in a state in which both the megaphone halves are opened in a V-shape (see, e.g., Patent Documents 1-6).

Furthermore, in this kind of sounding tool, for the purpose of enhancing the interesting nature, it is known to attach a mascot doll of a sport team to the sounding tool (see, e.g., Patent Documents 7 and 8).

Patent Document 1: Japanese-Unexamined Laid-open Patent Publication No. 2001-75573

Patent Document 2: Japanese Utility Model Registration No. 3062631

Patent Document 3: Japanese Patent No. 2996649

Patent Document 4: Japanese Examined Laid-open Utility Model Publication No. H03-20879

Patent Document 5: Japanese Unexamined Laid-open Utility Model Publication No. H05-45796

Patent Document 6: Japanese Unexamined Laid-open Patent Publication H10-91168

Patent Document 7: Japanese Design Registration No. 977617

Patent Document 8: Japanese Design Registration No. 1229544

Disclosure Of The Invention

Problems To Be Solved By The Invention

In a conventional sounding tool, the mascot doll was provided at either one of the clapping bars. Therefore, it is required to set the size of the mascot doll in accordance with the size of one of the clapping bars, which limits the degree of design freedom of the mascot doll. This results in deteriorated interesting nature. Furthermore, since the size of the mascot doll is limited, the mascot doll cannot be an attention-grabber.

The preferred embodiments of the present invention have been developed in view of the above-mentioned and/or other problems in the related art. The preferred embodiments of the present invention can significantly improve upon existing methods and/or apparatuses.

The present invention was made in order to solve the aforementioned problems, and aims to provide a highly interesting sounding tool for cheering.

Another objects and/or advantages of the present invention will be apparent from the following preferred embodiments.

Means To Solve The Problems

In order to attain the aforementioned objects, the present invention provides the following means.

[1] A sounding tool for cheering, comprising:

a pair of right and left clapping bars each having a beating portion and a gripping portion connected to a basal portion of the beating portion; and a hollow cover body having a shape imitating an object or a character for enhancing interest, wherein both the clapping bars are pivotally connected at a portion between the beating portion and the gripping portion of each clapping bar so that the beating portions can be opened/closed freely, wherein both the clapping bars are disposed between front and rear wall portions of the cover body so as to vertically penetrate the cover body with the cover body positioned at longitudinal intermediate positions of the clapping bars, wherein right clapping bar guide groove portions and left clapping bar guide groove portions are provided, respectively, on a right side and a left side of an inner surface of each wall portion of the cover body so as to be vertically apart from each other, wherein guide protruded portions are provided, respectively, on a front side and a rear side of each of the right and left clapping bars so as to be vertically apart from each other, wherein the guide protruded portions of the right clapping bar and the guide protruded portions of the left clapping bar are fitted, respectively, in the right clapping bar guide groove portions and the left clapping bar guide groove portions of the cover body, whereby the guide protruded portions are moved along the guide groove portions to thereby guide the beating portions of the right and left clapping bars in opening and closing directions, and wherein a stopper portion for restricting an opening movement of the beating portion of each of the right and left clapping bars is provided at an end portion of each guide groove portion.

[2] A sounding tool for cheering, comprising:

a pair of right and left clapping bars each having a beating portion and a gripping portion connected to a basal portion of the beating portion; and a hollow cover body having a shape imitating an object or a character for enhancing interest, wherein both the clapping bars are pivotally connected at a portion between the beating portion and the gripping portion of each clapping bar so that the beating portions can be opened/closed freely, wherein both the clapping bars are disposed between front and rear wall portions of the cover body so as to penetrate the cover body vertically with the cover body positioned at longitudinal intermediate positions of the clapping bars, wherein right clapping bar guide protruded portions and left clapping bar guide protruded portions are provided, respectively, on a right side and a left side of an inner surface of each wall portion of the cover body so as to be vertically apart from each other, wherein guide groove portions are provided, respectively, on a front side and a rear side of each of the right and left clapping bars so as to be vertically apart from each other, wherein the right clapping bar guide protruded portions and the left clapping bar guide protruded portions of the cover body are fitted, respectively, in the guide groove portions of the right clapping bar and the guide groove portions of the left clapping bar, whereby the guide protruded portions are moved along the guide groove portions with respect to the guide groove portions to thereby guide the beating portions of the right and left clapping bars in opening and closing directions, and wherein a stopper portion for restricting an opening movement of the beating portion of each of the right and left clapping bars is provided at an end portion of each guide groove portion.

[3] The sounding tool for cheering as recited in the aforementioned Item 1 or 2, wherein an elongated opening extending in the opening and closing directions of the beating portions of both the clapping bars is provided in an upper wall portion of the cover body, so that the beating portions of both the clapping bars protrude upwardly through the elongated opening, wherein when the beating portions of the right and left clapping bars are moved along front and rear edge portions of the elongated opening, the beating portions of the right and left clapping bars are guided in the opening and closing directions, and wherein when the beating portions of the right and left clapping bars collide with right and left edge portions of the elongated opening, opening movements of the beating portions of the right and left clapping bars are further restricted.

[4] The sounding tool for cheering as recited in the aforementioned Item 1 or 2, wherein the gripping portion of each of the right and left clapping bars is bent outward with respect to the beating portion, wherein each of the right and left clapping bars is hollow and has a voice releasing opening at its tip end portion, and wherein an embouchure hole is formed when the gripping portions of the clapping bars are joined with the beating portions of both the clapping bars opened, so that both the clapping bars can be used as a cheering megaphone.

[5] The sounding tool for cheering as recited in the aforementioned Item 1 or 2, wherein at least the beating portions of the right and left clapping bars are each shaped to imitate an object or a character for enhancing interest.

In this specification, for the purpose of making it easier to understand the structure of the sounding tool for cheering according to the present invention, the explanation is made by defining the opening and closing directions of the beating portions of both the clapping bars as right-and-left directions and the direction toward the tip end of the beating portion and the direction toward the basal end portion thereof as the upper direction and the lower direction respectively.

In the present invention as an object (including a part of an object) or a character for enhancing interest, an object (including a part of an object) or a character relating to sport or a sport team can be exemplified. Concretely, an object for use in sport (e.g., bat, ball, or glove), or a mascot, a uniform, a helmet or a player of a certain sport team can be exemplified.

EFFECTS OF THE INVENTION

The present invention has the following effects.

According to the invention as recited in the aforementioned Item [1], the sounding tool has a hollow cover body having a shape imitating an object or a character for enhancing interest, and clapping bars are disposed between the front and rear wall portions of the cover body so that the clapping bars vertically penetrate the cover body with the cover body positioned at longitudinal intermediate portions of the clapping bars. Accordingly, the size of the cover body can be set corresponding not to one of the clapping bars but to both the clapping bars. Therefore, the freedom of design of the cover body can be increased, resulting in enhanced interesting nature. Furthermore, since a bigger cover body can be designed, the cover body can be emphasized.

Furthermore, since both the clapping bars vertically penetrate the cover body between the front and rear wall portion of the cover body, the center of gravity of the cover body can be positioned on the central axis extending along the up-and-down direction of the clapping bars or at a portion vicinity thereof. As a result, there is an advantage that the sounding tool can be stably disposed on a table or desk in a room for ornamental purposes.

Furthermore, right clapping bar guide groove portions and left clapping bar guide groove portions are provided, respectively, at a right side and a left side of an inner surface of each wall portion of the cover body so as to be vertically apart from each other. While guide protruded portions are provided, respectively, at a front side and a rear side of each of the right and left clapping bars so as to be vertically apart from each other. The guide protruded portions of the right clapping bar and the guide protruded portions of the left clapping bar are fitted, respectively, in the right clapping bar guide groove portions and the left clapping bar guide groove portions, whereby the guide protruded portions are moved along the guide groove portions to thereby guide the right and left clapping bars in opening and closing directions. Therefore, the opening and closing operation of the beating portions of the right and left clapping bars can be performed smoothly.

Furthermore, since a stopper portion for restricting an opening movement of the beating portion of each of the right and left clapping bars is provided at an end portion of each guide groove portion, when the beating portions of the right and left clapping bars reach the maximum open positions, the opening movements of the beating portions of the right and left clapping bars can be controlled assuredly.

According to the invention as recited in the aforementioned Item [2], the same effects as those of the invention as recited in Item [1] can be produced.

According to the invention as recited in the aforementioned Item [3], when the beating portions of the right and left clapping bars are moved along front and rear edge portions of the elongated opening, the beating portions of the right and left clapping bars are guided in the opening and closing directions. This enables smoother opening and closing operation of the beating portions of the right and left clapping bars.

Furthermore, when the beating portions of the right and left clapping bars collide with right and left edge portions of the elongated opening, opening movements of the beating portions of the right and left clapping bars are also restricted. Therefore, when the beating portions of the right and left clapping bars reach the maximum opening positions, the opening movements of the beating portions of the right and left clapping bars can be controlled more assuredly.

According to the invention as recited in the aforementioned Item [4], since both the clapping bars are constituted such that they can be used as a cheering megaphone, voice can be amplified at the time of cheering with voice.

According to the invention as recited in the aforementioned Item [5], since each of the right and left clapping bars is shaped to imitate an object or a character for enhancing interest, a sounding tool for cheering further enhanced in interest can be provided.

DESCRIPTION OF REFERENCE NUMERALS

Figure 1:
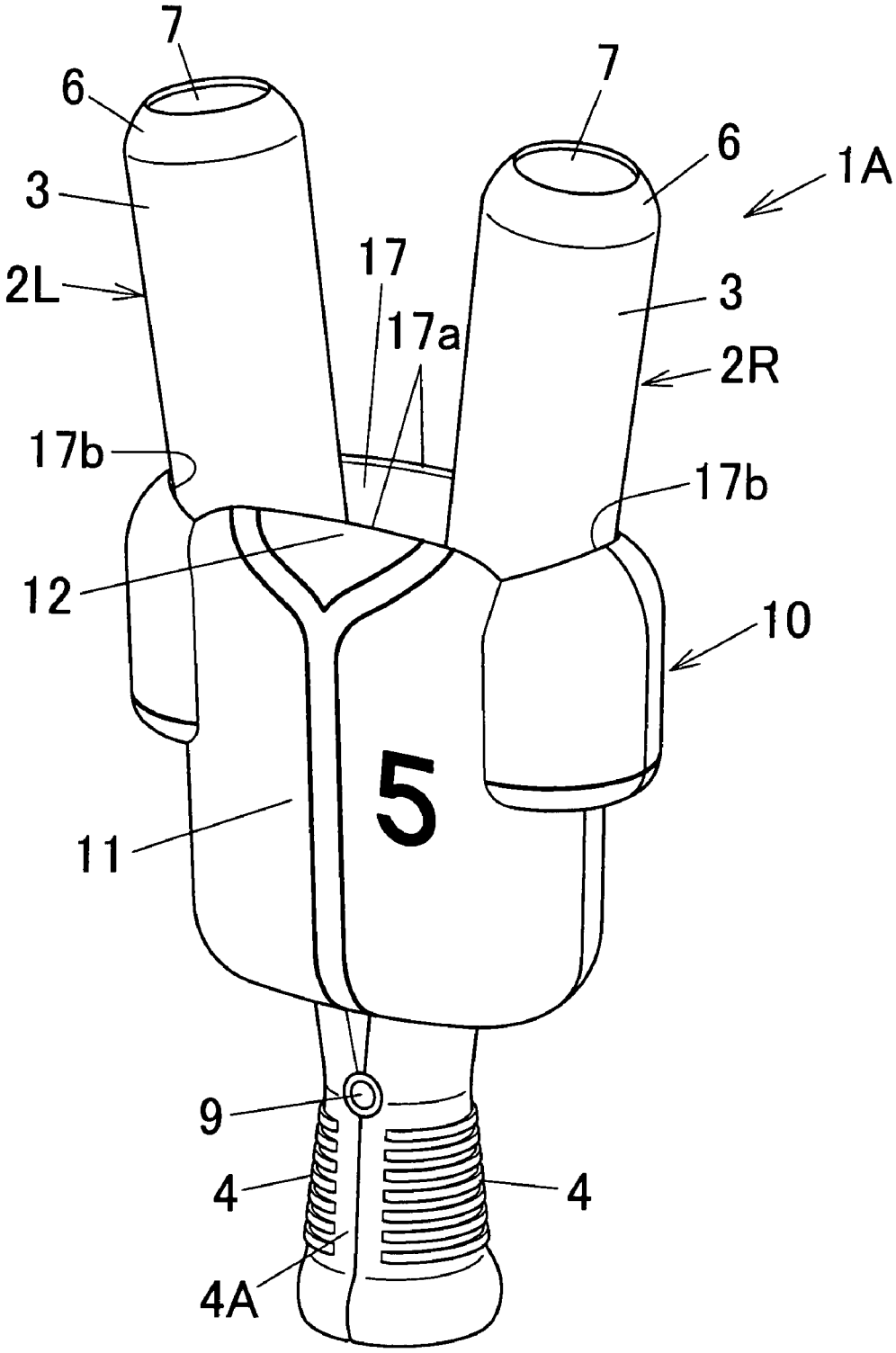
[FIG. 1] is a perspective view showing a sounding tool for cheering according to a first embodiment of the present invention.

1A, 1B, 1C . . . Sounding tool for cheering
2L, 2R . . . Right and left clapping bars
3 . . . Beating portion
4 . . . Gripping portion
4A . . . Gripping portion main body (embouchure portion)
5L, 5R . . . Guide protruded portion
7 . . . Voice releasing opening
9 . . . Pivotal shaft
10 . . . Cover body
11, 11 . . . Front and rear wall portions
15L, 15R . . . Guide groove portion
SL1, SR1 . . . Edge portion of the end portion of the guide groove portion (Stopper portion)
17 . . . Upper elongated opening (Elongated opening)
17*a*, 17*b* . . . Front and rear edge portions of an upper elongated opening
17*b*, 17*b* . . . Right and left edge portions of an upper elongated opening

BEST MODE FOR CARRYING OUT THE INVENTION

Next, some embodiments of the present invention will be explained with reference to the attached drawings.

FIGS. 1 to 6 are explanatory views showing a sounding tool for cheering according to a first embodiment of the present invention. In FIG. 1, "1A" denotes a sounding tool for cheering according to the first embodiment. This sounding tool 1A is used to cheer for a baseball team at the time of watching baseball as sports.

This sounding tool 1A is equipped with a pair of right and left clapping bars 2R and 2L and a hollow cover body 10.

Figure 2:
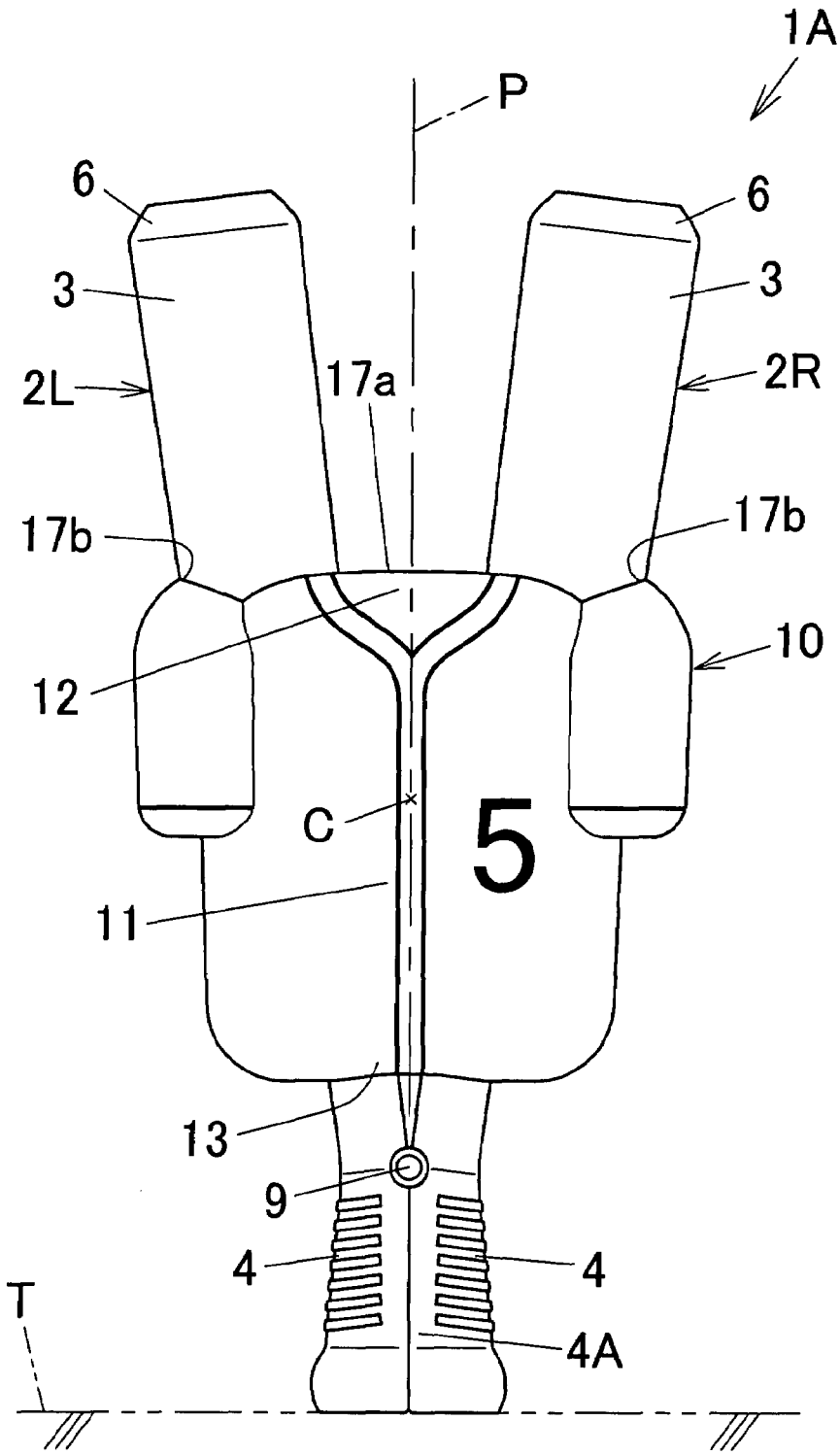
[FIG. 2] is a front view showing the sounding tool for cheering.
Figure 3:
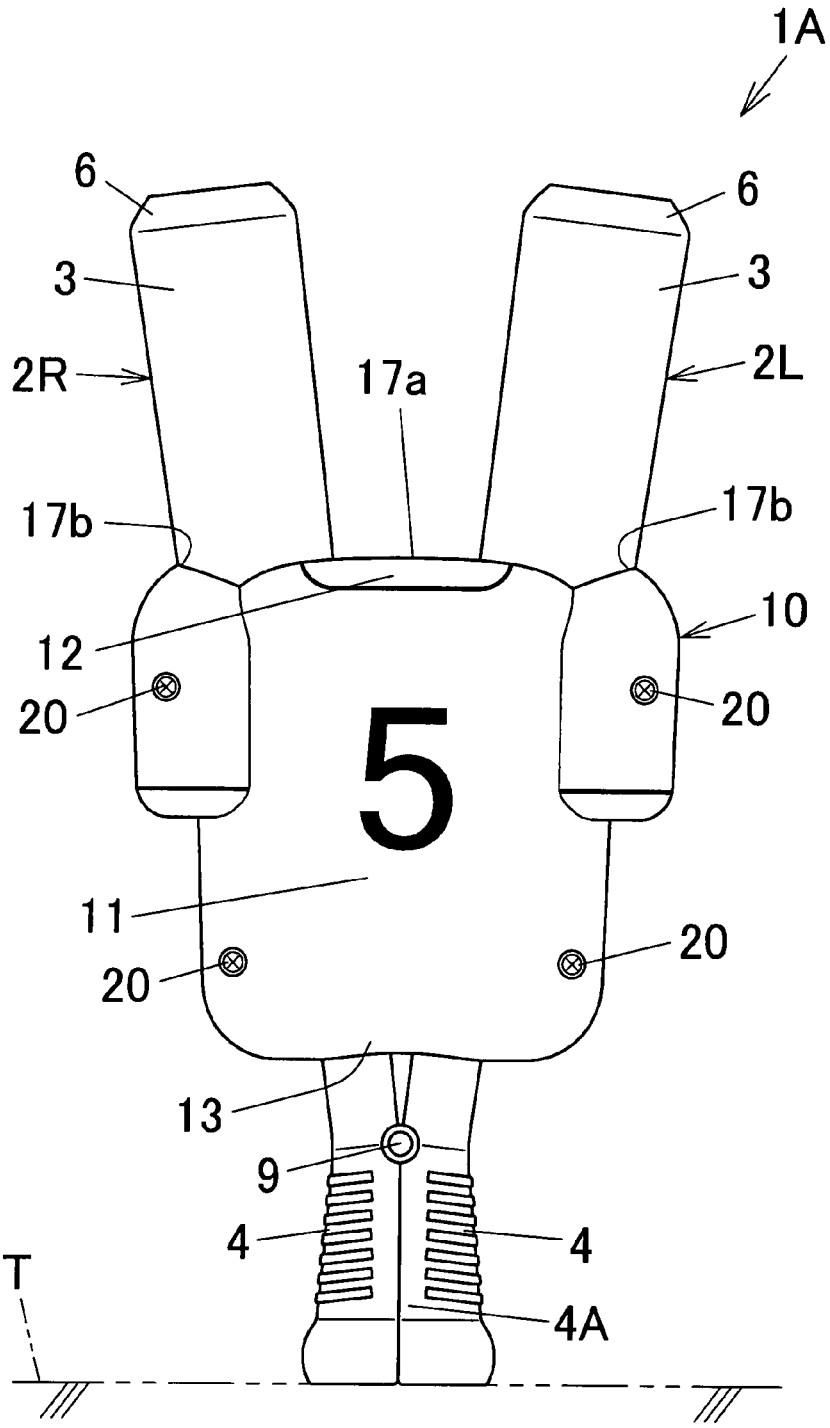
[FIG. 3] is a rear view showing the sounding tool for cheering.

The cover body 10 is aplastic hollow molded article having a shape imitating a uniform of a favorite baseball team as an object for enhancing interest as shown in FIGS. 1 to 3.

Figure 4:
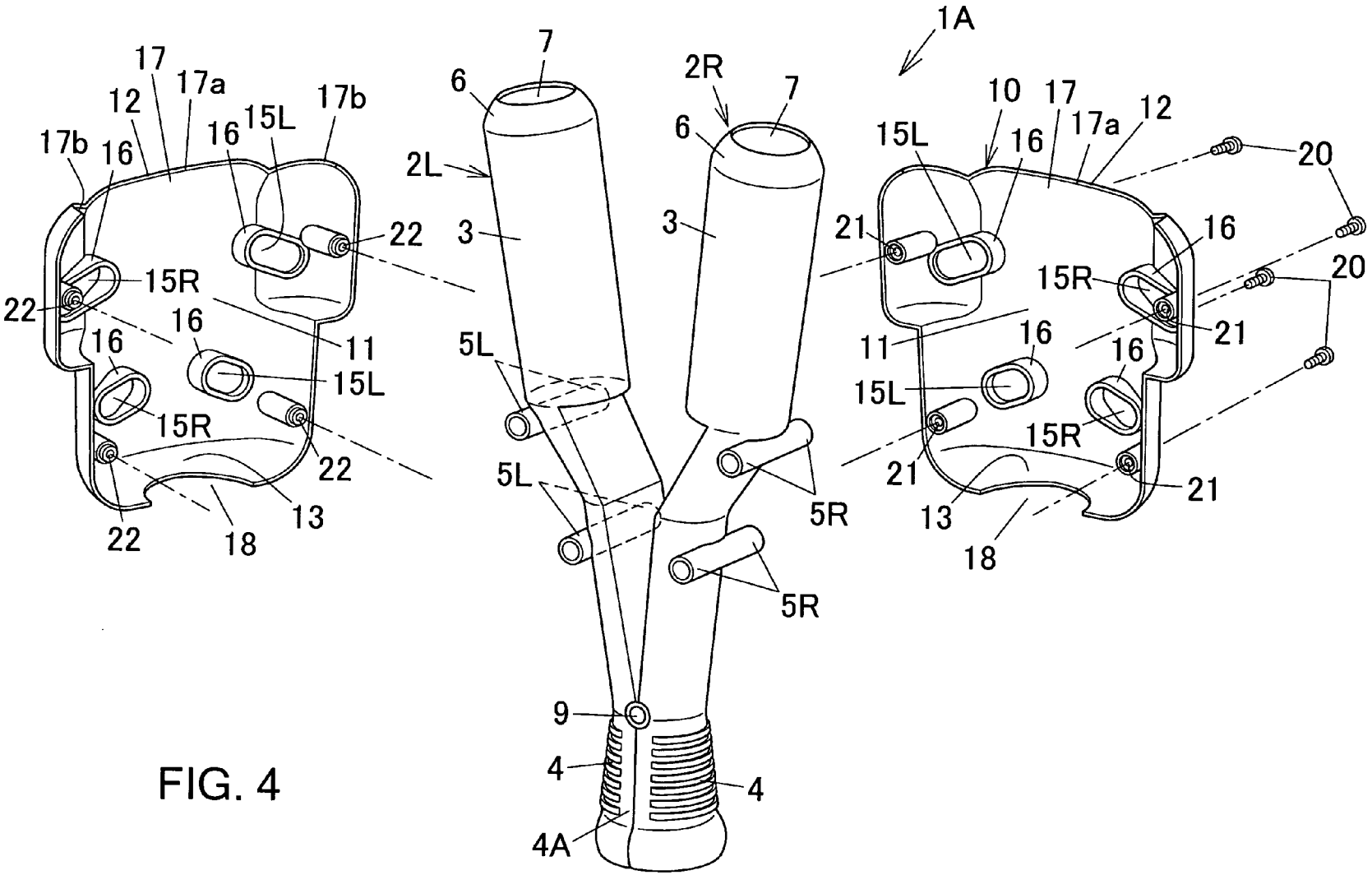
[FIG. 4] is an explored perspective view showing the sounding tool for cheering.

This cover body 10 is divided into two halves, or a front half and a rear half, as shown in FIG. 4. The front wall portion 11 and the rear wall portion 11 of the cover body 10 are mutually connected with a plurality of screws 20 (four pieces of screws in this embodiment) with both the clapping bars 2R and 2L sandwiched between the front wall portion 11 and the rear wall portion 11. "21" denotes a screw insertion hole for inserting the screw 20, and "22" denotes a screw hole to be screwed by the screw 20.

The right and left clapping bars 2R and 2L are the same in structure. Each clapping bar 2R and 2L is a hollow member, more specifically, a plastic hollow molded article. Each clapping bar 2R and 2L has a beating portion 3 and a gripping portion 4 as shown in FIGS. 2 and 3. The beating portion 3 is formed into a round cross-sectional shape. The gripping portion 4 is connected to the basal portion (lower portion) of the beating portion 3 via an outwardly bent generally V-shaped portion. In this embodiment, in detail, the gripping portion 4 is constituted by a gripping portion half formed by vertically dividing a cylindrical gripping portion main body 4A.

The beating portion 3 of each clapping bar 2R and 2L is formed into a shape imitating a hitting portion of a baseball bat as an object for enhancing interest. Furthermore, the gripping portion 4 is formed into a shape imitating a grip portion of the bat.

Furthermore, as shown in FIG. 1, a round-shaped voice releasing opening 7 is formed at the tip end portion 6 of the beating portion 3.

Both the clapping bars 2R and 2L are pivotally connected with each other openably and closably at a position between the beating portion 3 and the gripping portion 4 of the left clapping bar 2L and a position between the beating portion 3 and the gripping portion 4 of the right clapping bar 2R. "9" denotes a pivotal shaft pivotally connecting both the clapping bars 2R and 2L. This sounding tool 1A is configured to make a sound when the beating portions 3 and 3 of both the clapping bars 2R and 2L are closed and hit with each other.

Furthermore, as shown in FIGS. 2 and 3, in a state in which the beating portions 3 and 3 of both the clapping bars 2R and 2L are opened in a V-shape, the gripping portions 4 and 4 of both the clapping bars 2R and 2L are fitted each other to form a cylindrical gripping portion main body 4A. This gripping portion main body 4A corresponds to an embouchure hole of a cheering megaphone.

In this sounding tool 1A, both the clapping bars 2R and 2L vertically penetrate the cover body 10 between the front and rear wall portions 11 and 11 of the cover body 10. The cover body 10 is disposed at the longitudinal (vertical) intermediate portion of both the clapping bars 2R and 2L.

As shown in FIG. 1, the upper wall portion 12 of the cover body 10 has an upper elongated opening 17 extending in the opening and closing directions (i.e., the right-and-left direction) of the beating portions 3 and 3 of both the clapping bars 2R and 2L. The beating portions 3 and 3 of both the clapping bars 2R and 2L upwardly protrude from the cover body 10 between the front and rear wall portions 11 and 11 of the cover body 10 via the upper elongated opening 17, so that they are exposed outside.

Figure 5:
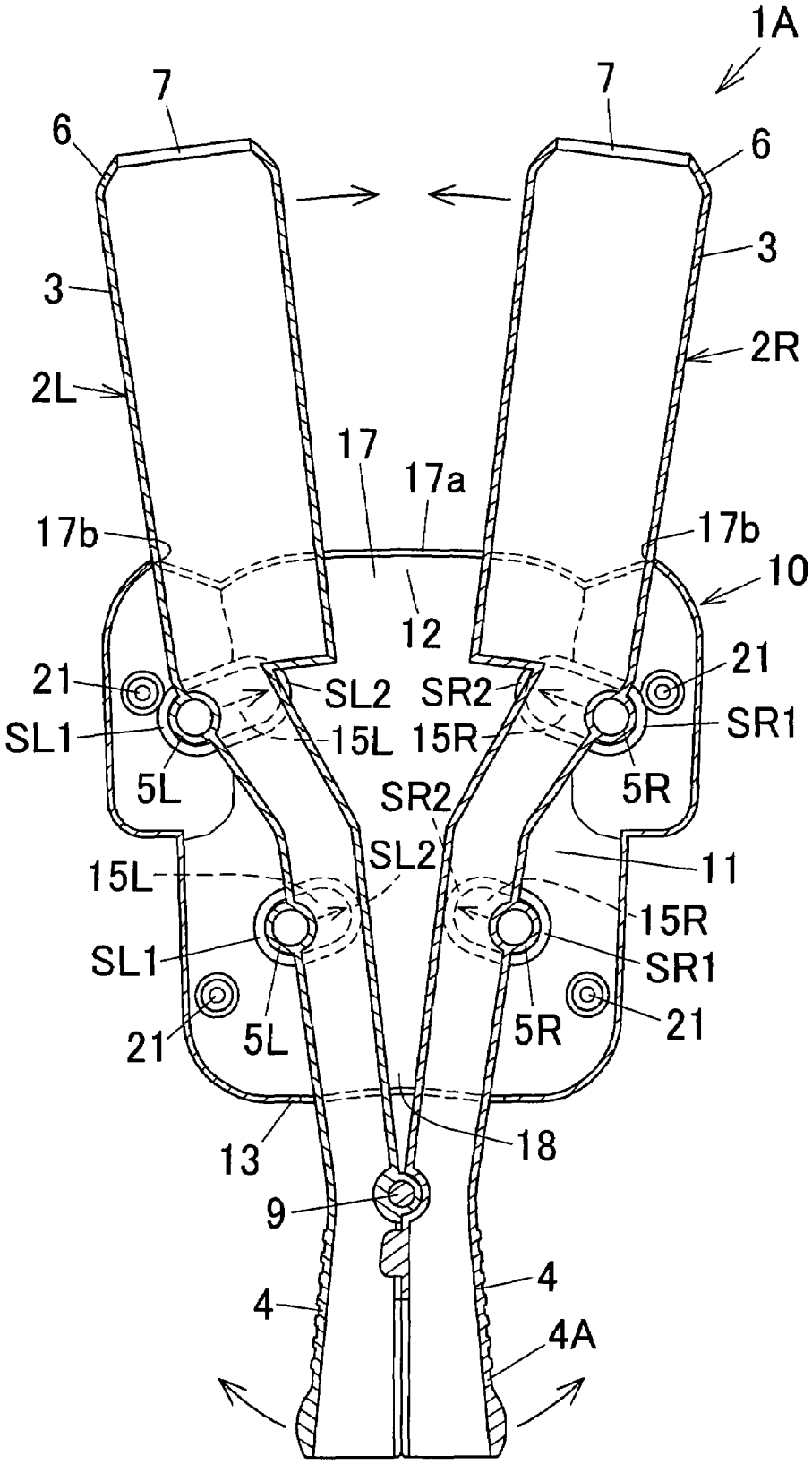
[FIG. 5] is a vertical cross-sectional view of the sounding tool for cheering in a state in which both the beating portions of the clapping bars are opened.

On the other hand, as shown in FIG. 5, the lower wall portion 13 of the cover body 10 has a lower elongated opening 18 extending in the opening and closing directions of the beating portions 3 and 3 of both the clapping bars 2R and 2L. Both the gripping portions 4 and 4 downwardly protrude from the cover body 10 between the front and rear wall portions 11 and 11 of the cover body 10 via the lower elongated opening 13, so that they are exposed outside.

As shown in FIG. 4, left clapping bar guide groove portions 15L each extending in opening and closing directions (right-and-left directions) of the left clapping bar 2L are provided on a left side inner surface of each of the front and rear wall portions 11 and 11 of the cover body 10 so as to be vertically apart from each other. Furthermore, right clapping bar guide groove portions 15R each extending in opening and closing directions (right-and-left directions) of the right clapping bar 2R are provided on a right side inner surface of each of the front and rear wall portions 11 and 11 of the cover body 10 so as to be vertically apart from each other. A peripheral wall portion 16 is protrudingly provided on each of a peripheral edge of the guide groove portions 15L and 15R.

On the other hand, at positions vertically spaced apart on each of the front and rear surfaces of the left clapping bar 2L, guide protruded portions 5L corresponding to the left clapping bar guide groove portions 15L are provided. Furthermore, at positions vertically spaced apart on each of the front and rear surfaces of the right clapping bar 2R, guide protruded portions 5R corresponding to the right clapping bar guide groove portions 15R are provided.

Figure 6:
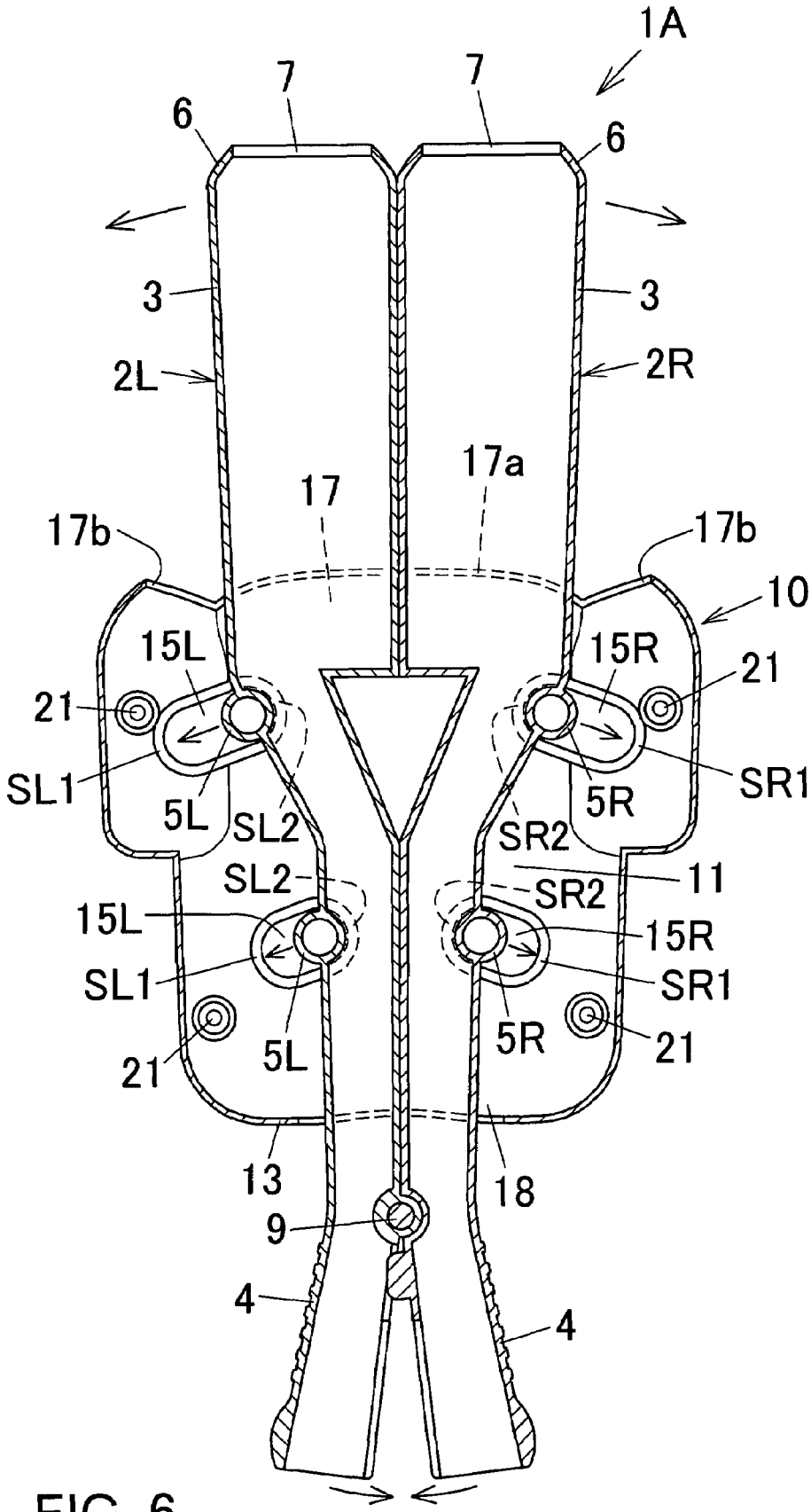
[FIG. 6] is a vertical cross-sectional view of the sounding tool for cheering in a state in which both the beating portions of the clapping bars are closed.

As mentioned above, the front wall portion 11 and the rear wall portion 11 of the cover body 10 are mutually connected each other with a plurality of screws 20 with both the clapping bars 2R and 2L sandwiched therebetween. In this state, as shown in FIGS. 5 and 6, the guide protruded portions 5L of the left clapping bar 2L are fitted in (i.e., engaged in) the left clapping bar guide groove portions 15L. In this fitted state (engaged state), when the guide protruded portions 5L of the left clapping bar 2L are moved in right-and-left directions along the left clapping bar guide groove portions 15L, the beating portion 3 of the left clapping bar 2L is guided in the opening and closing directions. Furthermore, in the same manner, the guide protruded portions 5R of the right clapping bar 2R are fitted in (i.e., engaged in) the right clapping bar guide groove portions 15R. In this fitted state (engaged state), when the guide protruded portions 5R of the right clapping bar 2R are moved in right-and-left directions along the right clapping bar guide groove portions 15R, the beating portion 3 of the right clapping bar 2R is guided in the opening and closing directions.

In using the sounding tool 1A of this embodiment for cheering, as shown in FIG. 5, the gripping portions 4 and 4 of both the clapping bars 2R and 2L are grabbed lightly with one hand to open the beating portions 3 and 3 of both the clapping bars 2R and 2L in a V-shape. With this state, the cover body 10 is hit against the other hand by swinging both the clapping bars 2R and 2L. At that time, due to the impact, the beating portions 3 and 3 of both the clapping bars 2R and 2L move in a closing direction to cause a collision (hitting) of the beating portions 3 and 3 to thereby make a sound (see FIG. 6). By repeating this movement, a sound caused by the collision of the beating portions 3 and 3 can be made repeatedly.

Movements of both the clapping bars 2R and 2L in a hitting-and-sounding operation will be detailed as follows.

When the cover body 10 is hit against the other hand by swinging both the clapping bars 2R and 2L with the beating portions 3 and 3 of both the clapping bars 2R and 2L opened in a V-shape, closing force will be applied to each of the beating portions 3 and 3 of both the clapping bars 2R and 2L due to the impact. As a result, the guide protruded portions 5L of the left clapping bar 2L move along the left clapping bar guide groove portions 15L of the cover body 10. With this, the beating portion 3 of the left clapping bar 2L is assuredly guided in a closing direction. At this time, the beating portion 3 of the left clapping bar 2L moves along the front and rear edge portions 17*a* and 17*a* of the upper elongated opening 17. With this, the beating portion 3 of the left flapping bar 2L is more assuredly guided in the closing direction. In the same manner, the guide protruded portions 5R of the right clapping bar 2R move along the right clapping bar guide groove portions 15R. With this, the beating portion 3 of the right clapping bar 15R is guided in a closing direction. At this time, the beating portion 3 of the right clapping bar 2R moves along the front and rear edge portions 17*a* and 17*a* of the upper elongated opening 17. With this, the beating portion 3 of the right flapping bar 2R is more assuredly guided in the closing direction. Thus, the closing movement of the beating portions 3 and 3 of the right and left clapping bars 2R and 2L can be performed smoothly.

Then, as shown in FIG. 6, the beating portions 3 and 3 of both the clapping bars 2R and 2L guided in the closing direction respectively hit with each other to make a sound.

As shown in this figure, in a state in which the beating portions 3 and 3 of both the clapping bars 2R and 2L are hit and closed, the guide protruded portions 5L of the left clapping bar 2L collide with the right end edge portions SL2 of the left clapping bar guide groove portions 15L, which restricts the further closing movement of the beating portion 3 of the left clapping bar 2L. Thus, these edge portions SL2 function as closing movement restriction left stopper portions which restrict the closing movement of the beating portion 3 of the left clapping bar 2L. In the same manner, the guide protruded portions 5R of the right clapping bar 2R collide with the left end edge portions SR2 of the right clapping bar guide groove portions 15R, which restricts the further closing movement of the beating portion 3 of the right clapping bar 2R. Thus, these edge portions SR2 function as closing movement restriction right stopper portions which restrict the closing movement of the beating portion 3 of the right clapping bar 2R.

Furthermore, as shown in this figure, in a state in which the beating portions 3 and 3 of both the clapping bars 2R and 2L are closed, both the gripping portions 4 and 4 are in an opened state.

On the other hand, in order to change the beating portions 3 and 3 of both the clapping bars 2R and 2L from the closed state of the beating portions 3 and 3 of both the clapping bars 2R and 2L (see FIG. 6) to the opened state of the beating portions 3 and 3 of both the clapping bars 2R and 2L in a V-shape (see FIG. 5), both the gripping portions 4 and 4 are gripped with one hand to move the gripping portions 4 and 4 in the closing directions with the gripping force. At this time, opening force will be applied to the beating portions 3 and 3 of both the clapping bars 2R and 2L and the beating portions 3 and 3 start opening movements about the pivotal shaft 9. As a result, the guide protruded portions 5L of the left clapping bar 2L move along the left clapping bar guide groove portions 15L of the cover body 10, which guides the beating portion 3 of the left clapping bar 2L in the opening direction. At this time, the beating portion 3 of the left clapping bar 2L moves along the front and rear edge portions 17*a* and 17*a* of the upper elongated opening 17, which assuredly guides the beating portion 3 of the left clapping bar 2L in the opening direction. In the same manner, the guide protruded portions 5R of the right clapping bar 2R move along the right clapping bar guide groove portions 15R of the cover body 10, which guides the beating portion 3 of the right clapping bar 2R in the opening direction. At this time, the beating portion 3 of the right clapping bar 2R moves along the front and rear edge portions 17*a* and 17*a* of the upper elongated opening 17, which assuredly guides the beating portion 3 of the right clapping bar 2R in the opening direction. Accordingly, the opening movements of the beating portions 3 and 3 of the right and left clapping bars 2R and 2L can be performed smoothly.

As shown in FIG. 5, when the beating portions 3 and 3 of both the clapping bars 2R and 2L reach the maximum open positions, the guide protruded portions 5L of the left clapping bar 2L collide with the left end edge portions SL1 of the left clapping bar guide groove portions 15L of the cover body 10, which restricts the further opening movement of the beating portion 3 of the left clapping bar 2L. Therefore, these edge portions SL1 function as opening movement restriction left stopper portions which restrict the opening movement of the beating portion 3 of the left clapping bar 2L. In the same manner, the guide protruded portions 5R of the right clapping bar 2R collide with the right end edge portions SR1 of the right clapping bar guide groove portions 15R of the cover body 10, which restricts the further opening movement of the beating portion 3 of the right clapping bar 2R. Therefore, these edge portions SR1 function as opening movement restriction right stopper portions which restrict the opening movement of the beating portion 3 of the right clapping bar 2R. Thus, according to this sounding tool 1A, when the beating portions 3 and 3 of the right and left clapping bars 2R and 2L reach the maximum open positions, the opening movements of the beating portions 3 and 3 of the right and left clapping bars 2R and 2L can be assuredly controlled.

Furthermore, when the beating portions 3 and 3 of the right and left clapping bars 2R and 2L reach the maximum open positions, the beating portion 3 of the left clapping bar 2L collides with the left edge portion 17*b* of the upper elongated opening 17 of the cover body 10. With this, the further opening movement of the beating portion 3 of the left clapping bar 2L is also controlled. In the same manner, the beating portion 3 of the right clapping bar 2R collides with the right edge portion 17*b* of the upper elongated opening 17 of the cover body 10. With this, the further opening movement of the beating portion 3 of the right clapping bar 2R is also controlled. Thus, according to this sounding tool 1A, when the beating portions 3 and 3 of the right and left clapping bars 2R and 2L reach the maximum open positions, the opening movements of the beating portions 3 and 3 of the right and left clapping bars 2R and 2L can be more assuredly controlled.

Furthermore, when the beating portions 3 and 3 of the right and left clapping bars 2R and 2L reach the maximum open positions, as shown in FIG. 5, the gripping portions 4 and 4 of both the clapping bars 2R and 2L are closed and fitted with each other, which forms a cylindrical gripping portion main body 4A functioning as an embouchure hole of a megaphone. In the case of cheering with voice, the sounding tool 1A is set to the state as shown in FIG. 5, and the gripping portion main body 4A is used as an embouchure hole portion of a megaphone to which a user's mouth is approached to amplify the voice.

When this sounding tool 1A is not in use, as shown in FIGS. 2 and 3, the sounding tool 1A is disposed on, e.g., a table or a desk T in a room with the gripping portions 4 and 4 facing down in a state in which the beating portions 3 and 3 of the clapping bars 2R and 2L are opened in a V-shape. Thus, the sounding tool 1A can also be used as an interior ornament. In this case, in the sounding tool 1A, since the clapping bars 2L and 2R vertically penetrate the cover body 10 between the front and rear wall portions 11 and 11, the gravity center C of the cover body 10 is positioned on the vertical central axis P extending along the vertical direction of the clapping bars 2R and 2L or the vicinity thereof. Thus, the sounding tool 1A can be disposed stably, which hardly causes falling.

Thus, according to this sounding tool 1A, the size of the cover body 10 can be set corresponding not to the size of one of the clapping bars but to the total size of both the clapping bars 2R and 2L. Therefore, the freedom of design of the cover body 10 can be increased, resulting in enhanced interesting nature. Furthermore, since a bigger cover body 10 can be designed, the cover body 10 can be distinguished.

Furthermore, the beating portions 3 and 3 and the gripping portions 4 and 4 of the right and left clapping bars 2R and 2L exposed outside the cover body 10 are formed into a shape imitating a hitting portion of a bat and a shape imitating a gripping portion of a bat, respectively, which can further enhance the interest.

Furthermore, since both the clapping bars 2R and 2L can also be used as a cheering megaphone, a voice can be amplified at the time of cheering with voice.

Furthermore, the sounding operation of this sounding tool 1A is performed by hitting the cover body 10 against a user's hand by swinging both the clapping bars 2R and 2L. Therefore, it can be prevented fingers from being pinched between the beating portions 3 and 3 of the clapping bars 2R and 2L at the time of the sounding operation.

Figure 7:
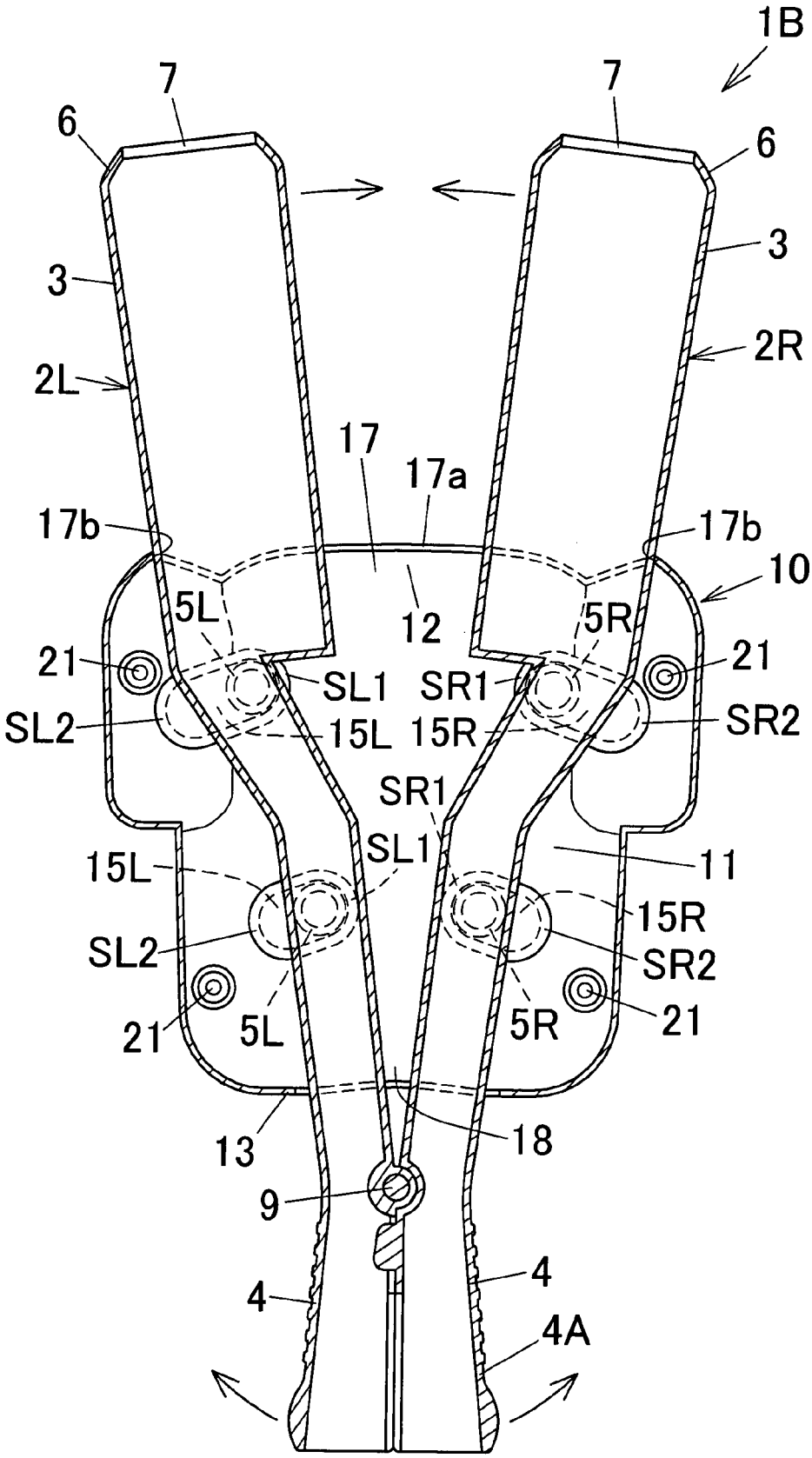
[FIG. 7] is a vertical cross-sectional view of the sounding tool for cheering according to a second embodiment in a state in which both the beating portions of the clapping bars are opened.
Figure 8:
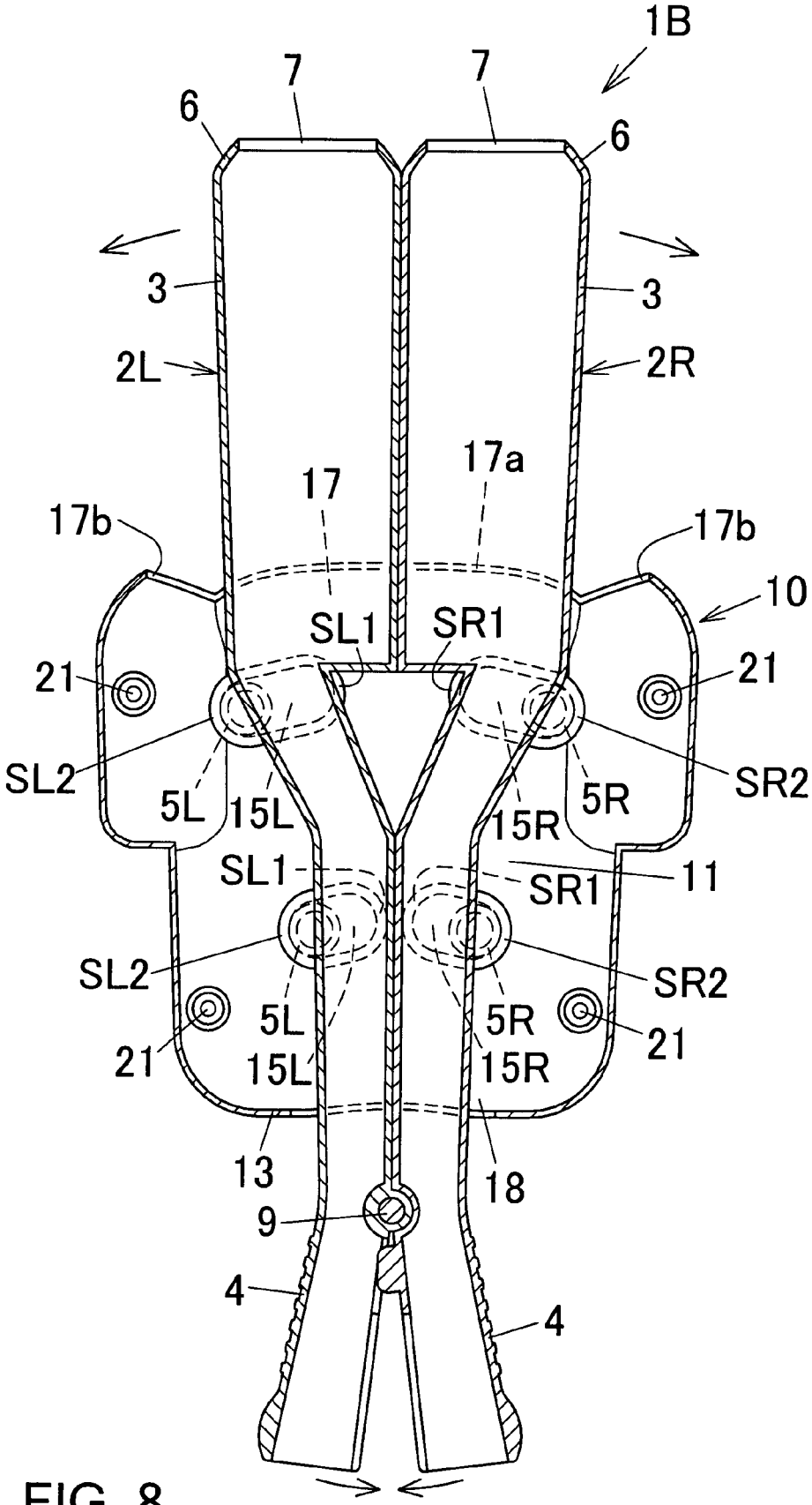
[FIG. 8] is a vertical cross-sectional view of the sounding tool for cheering according to the second embodiment in a state in which both the beating portions of the clapping bars are closed.

FIGS. 7 and 8 are explanatory views showing a sounding tool for cheering according to a second embodiment of the present invention. In FIGS. 7 and 8, the same elements as in the sounding tool 1A of the first embodiment are allotted by the same reference numerals. The structure of this sounding tool 1B will be explained by mainly focusing on the differences with the sounding tool 1A of the first embodiment.

In this sounding tool 1B, left clapping bar guide protruded portions 5L are provided on the inner left side surface of each of the front and rear wall portions 11 and 11 of the cover body 10 so as to be vertically apart from each other. Furthermore, right clapping bar guide protruded portions 5R are provided on the inner right side surface of each of the front and rear wall portions 11 and 11 of the cover body 10 so as to be vertically apart from each other. On the other hand, guide groove portions 15L corresponding to the left clapping bar guide protruded portions 5L are provided on the front and rear surfaces of the left clapping bar 2L so as to be vertically apart from each other. Furthermore, guide groove portions 15R corresponding to the right clapping bar guide protruded portions 5R are provided on the front and rear surfaces of the right clapping bar 2R so as to be vertically apart from each other. The left clapping bar guide protruded portions 5L are fitted in the guide groove portions 15L of the left clapping bar 2L, and the right clapping bar guide protruded portions 5R are fitted in the guide groove portions 15R of the right clapping bar 2R. When the guide groove portions 15L move so that the left clapping bar guide protruded portions 5L move along the guide groove portions 15L (i.e., when the left clapping bar guide protruded portions 5L move along the guide groove portions 15L relative to the guide groove portions 15L), the beating portion 3 of the left clapping bar 2L is guided in the opening and closing directions. Furthermore, when the guide groove portions 15R move so that the right clapping bar guide protruded portions 5R move along the guide groove portions 15R (i.e., when the right clapping bar guide protruded portions 5R move along the guide groove portions 15R relative to the guide groove portions 15R), the beating portion 3 of the right clapping bar 2R is guided in the opening and closing directions.

The other structure and usage of this sounding tool 1B are the same as those of the sounding tool 1A of the first embodiment.

Figure 9:
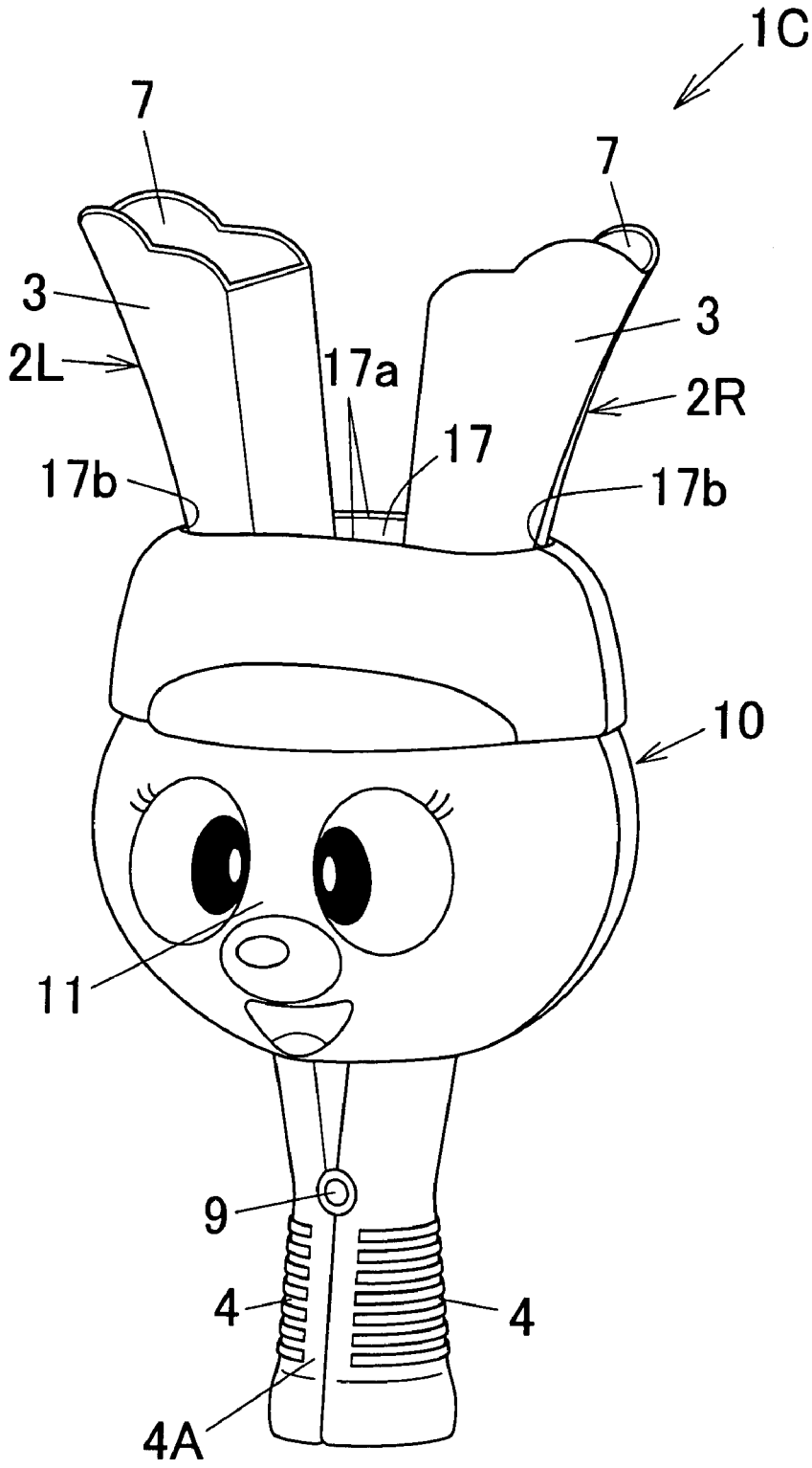
[FIG. 9] is a perspective view showing a sounding tool for cheering according to a third embodiment of the present invention.

FIG. 9 is an explanatory view showing a sounding tool for cheering according to a third embodiment of the present invention. In FIG. 9, the same reference numeral is allotted to the same element as that of the first embodiment 1A. The structure of this sounding tool 1C will be explained by focusing on the differences with the sounding tool 1A of the first embodiment.

In this sounding tool 1C, the cover body 10 is formed into a shape imitating a head portion of a mascot of a sport team. The beating portions 3 and 3 of the clapping bars 2R and 2L are formed into shapes imitating horns or ears of the mascot.

Other structure and usage of this sounding tool 1C are the same as those in the sounding tool 1A of the first embodiment.

Although several embodiments of the present invention were explained above, the present invention is not limited to the embodiments and allows the modification thereof in various manners.

For example, in the aforementioned first to third embodiments, as an example of an object or a character for enhancing interest, the cover body 1 is shaped to imitate a uniform or a mascot of a sport team. In this invention, however, the cover body 10 can be formed into a shape imitating, e.g., a player of a sport team, or an object used in sports (e.g., a bat, a ball, a glove), or any shape imitating any other object or character.

INDUSTRIAL APPLICABILITY

The present invention can be applied to a sounding tool for cheering used at the time of watching various sports, such as, e.g., baseball, volleyball, soccer, or basketball.

This application claims priority to Japanese Patent Application No. 2005-212401 filed on Jul. 22, 2005, the disclosure of which is incorporated by reference in its entirety.

The terms and expressions which have been employed herein are used as terms of description and not of limitation, and there is no intent, in the use of such terms and expressions, of excluding any of the equivalents of the features shown and described or portions thereof, but it is recognized that various modifications are possible within the scope of the invention claimed.

While the present invention may be embodied in many different forms, a number of illustrative embodiments are described herein with the understanding that the present disclosure is to be considered as providing examples of the principles of the invention and such examples are not intended to limit the invention to preferred embodiments described herein and/or illustrated herein.

While illustrative embodiments of the invention have been described herein, the present invention is not limited to the various preferred embodiments described herein, but includes any and all embodiments having equivalent elements, modifications, omissions, combinations (e.g., of aspects across various embodiments), adaptations and/or alterations as would be appreciated by those in the art based on the present disclosure. The limitations in the claims are to be interpreted broadly based on the language employed in the claims and not limited to examples described in the present specification or during the prosecution of the application, which examples are to be construed as non-exclusive.

The invention claimed is

1. A sounding tool for cheering, comprising:

a pair of right and left clapping bars each having a beating portion and a gripping portion connected to a basal portion of the beating portion; and a hollow cover body having a shape imitating an object or a character for enhancing interest, wherein both the clapping bars are pivotally connected at a portion between the beating portion and the gripping portion of each clapping bar so that the beating portions can be opened/closed freely, wherein both the clapping bars are disposed between front and rear wall portions of the cover body so as to vertically penetrate the cover body with the cover body positioned at longitudinal intermediate positions of the clapping bars, wherein right clapping bar guide groove portions and left clapping bar guide groove portions are provided, respectively, on a right side and a left side of an inner surface of each wall portion of the cover body so as to be vertically apart from each other, wherein guide protruded portions are provided, respectively, on a front side and a rear side of each of the right and left clapping bars so as to be vertically apart from each other, wherein the guide protruded portions of the right clapping bar and the guide protruded portions of the left clapping bar are fitted, respectively, in the right clapping bar guide groove portions and the left clapping bar guide groove portions of the cover body, whereby the guide protruded portions are moved along the guide groove portions to thereby guide the beating portions of the right and left clapping bars in opening and closing directions, and wherein a stopper portion for restricting an opening movement of the beating portion of each of the right and left clapping bars is provided at an end portion of each guide groove portion.

2. A sounding tool for cheering, comprising:

a pair of right and left clapping bars each having a beating portion and a gripping portion connected to a basal portion of the beating portion; and a hollow cover body having a shape imitating an object or a character for enhancing interest, wherein both the clapping bars are pivotally connected at a portion between the beating portion and the gripping portion of each clapping bar so that the beating portions can be opened/closed freely, wherein both the clapping bars are disposed between front and rear wall portions of the cover body so as to vertically penetrate the cover body with the cover body positioned at longitudinal intermediate positions of the clapping bars, wherein right clapping bar guide protruded portions and left clapping bar guide protruded portions are provided, respectively, on a right side and a left side of an inner surface of each wall portion of the cover body so as to be vertically apart from each other, wherein guide groove portions are provided, respectively, on a front side and a rear side of each of the right and left clapping bars so as to be vertically apart from each other, wherein the right clapping bar guide protruded portions and the left clapping bar guide protruded portions of the cover body are fitted, respectively, in the guide groove portions of the right clapping bar and the guide groove portions of the left clapping bar, whereby the guide protruded portions are moved along the guide groove portions with respect to the guide groove portions to thereby guide the beating portions of the right and left clapping bars in opening and closing directions, and wherein a stopper portion for restricting an opening movement of the beating portion of each of the right and left clapping bars is provided at an end portion of each guide groove portion.

3. The sounding tool for cheering as recited in claim 1 or 2, wherein an elongated opening extending in the opening and closing directions of the beating portions of both the clapping bars is provided in an upper wall portion of the cover body, so that the beating portions of both the clapping bars protrude upwardly through the elongated opening, wherein when the beating portions of the right and left clapping bars are moved along front and rear edge portions of the elongated opening, the beating portions of the right and left clapping bars are guided in the opening and closing directions, and wherein when the beating portions of the right and left clapping bars collide with right and left edge portions of the elongated opening, opening movements of the beating portions of the right and left clapping bars are further restricted.

4. The sounding tool for cheering as recited in claim 1 or 2, wherein the gripping portion of each of the right and left clapping bars is bent outward with respect to the beating portion, wherein each of the right and left clapping bars is hollow and has a voice releasing opening at its tip end portion, and wherein an embouchure hole is formed when the gripping portions of the clapping bars are joined with the beating portions of both the clapping bars opened, so that both the clapping bars can be used as a cheering megaphone.

5. The sounding tool for cheering as recited in claim 1 or 2, wherein at least the beating portions of the right and left clapping bars are each shaped to imitate an object or a character for enhancing interest.

* * * * *